US008746917B2

(12) United States Patent
Zimmerman

(10) Patent No.: US 8,746,917 B2
(45) Date of Patent: Jun. 10, 2014

(54) FAN BASE WITH ILLUMINATED MIRROR AND FAN

(76) Inventor: Barbara D. Zimmerman, St. Louis, MO (US)

( * ) Notice: Subject to any disclaimer, the term of this patent is extended or adjusted under 35 U.S.C. 154(b) by 39 days.

(21) Appl. No.: 13/608,552

(22) Filed: Sep. 10, 2012

(65) Prior Publication Data

US 2013/0077292 A1 Mar. 28, 2013

Related U.S. Application Data

(60) Provisional application No. 61/626,318, filed on Sep. 23, 2011.

(51) Int. Cl.
*F21V 33/00* (2006.01)
*A47G 1/20* (2006.01)

(52) U.S. Cl.
CPC ..... *A47G 1/20* (2013.01)
USPC ..... 362/139; 362/135; 362/142; 362/234; 359/876; 219/220; 248/480

(58) Field of Classification Search
USPC ..... 362/135, 139, 142, 234; 359/876; 219/219, 220; 248/279.1, 480
See application file for complete search history.

(56) References Cited

U.S. PATENT DOCUMENTS

| | | | | | |
|---|---|---|---|---|---|
| 3,392,950 | A | * | 7/1968 | Pierce | 248/279.1 |
| 3,781,093 | A | * | 12/1973 | Grabijas | 359/876 |
| 4,653,201 | A | * | 3/1987 | Seaman | 34/90 |
| 4,856,888 | A | * | 8/1989 | Wahl | 359/881 |
| 5,090,300 | A | * | 2/1992 | Berenstein | 454/370 |
| D460,542 | S | * | 7/2002 | Li | D23/328 |
| D544,595 | S | * | 6/2007 | Kung | D23/382 |
| 8,128,245 | B2 | * | 3/2012 | Limjoco | 359/872 |
| 2010/0118520 | A1 | | 5/2010 | Stern et al. | |

* cited by examiner

*Primary Examiner* — Ali Alavi
(74) *Attorney, Agent, or Firm* — Dale J. Ream

(57) ABSTRACT

A fan base and illuminated mirror apparatus for use in cooling a user's neck and torso while the user is positioned adjacent the apparatus includes a base member having upper and lower portions. A fan member is pivotally coupled to the base member and selectively movable between upward and downward directed configurations. A length adjustable rod is coupled to the upper portion of the base member and extending upwardly therefrom, the rod being selectively movable between expanded and retracted configurations. A mirror is operatively coupled to an upper end of the rod such that the mirror is vertically displaced from the fan member, the mirror being movable between straight and tilted configurations. The apparatus includes a light coupled to the mirror and electrically connected to a power source, the light configured to illuminate the mirror when energized.

14 Claims, 5 Drawing Sheets

FAN BASE WITH ILLUMINATED MIRROR AND FAN

CROSS REFERENCE TO RELATED APPLICATION

This non-provisional patent application claims the benefit of provisional application Ser. No. 61/626,318 filed on Sep. 23, 2011, titled Fan Base.

BACKGROUND OF THE INVENTION

This invention relates generally to integrated mirror and fan devices and, more particularly, to a fan base with an illuminated mirror and fan. The present invention is configured such that a fan member directs its discharged air away from a user's face and eyes when the user is looking into the mirror.

A woman often applies makeup using a makeup mirror device in the bathroom immediately after showering. A problem frequently encountered with this progression of events is that the bathroom may be very hot and steamy. This can lead to a woman perspiring excessively after already showering. Further, middle aged women may also experience hot flashes that simply add to an already uncomfortable environment. In either instance, a woman may have to seek a cooler environment for a period of time which may result in being late for work or another appointment.

Various devices have been proposed in the art that attempt to overcome the uncomfortable heat of a post-shower bathroom environment. For instance, U.S. Pat. No. 5,090,300 and US Publication No. 2008/12240748 disclose mirror devices having fan components. Unfortunately, however, these references direct air directly into the face of the user which is disadvantageous for at least the following reasons:

- Leads to drying out of eyes, eye irritation, and difficulty applying makeup;
- Blows powdered makeup into the eyes of the user;
- Cools only the face and not the chest, neck, and upper core of the user so as to minimize body cooling.

The existing devices also propose devices having telescopic features so that it is easier to look into without leaning over. For instance, U.S. Pat. No. 6,347,876 proposes a telescopic makeup mirror. However, the existing telescopic mirrors do not suggest integration of a fan.

Therefore, it would be desirable to have a fan base having a telescopic mirror structure and a fan that may be selectively directed away from a user's face and eyes. Further, it would be desirable to have a fan base with a mirror and fan that also includes a light that illuminates the mirror. In addition, it would be desirable to have a fan base in which the fan and the mirror are displaced from each other and are independently adjustable.

SUMMARY OF THE INVENTION

A fan base and illuminated mirror apparatus for use in cooling a user's neck and torso while the user is positioned adjacent the apparatus according to the present invention includes a base member having upper and lower portions. A fan member is pivotally coupled to the base member and selectively movable between upward and downward directed configurations. A length adjustable rod is coupled to the upper portion of the base member and extending upwardly therefrom, the rod being selectively movable between expanded and retracted configurations. A mirror is operatively coupled to an upper end of the rod such that the mirror is vertically displaced from the fan member, the mirror being movable between straight and tilted configurations. The apparatus includes a light coupled to the mirror and electrically connected to a power source, the light configured to illuminate the mirror when energized. The fan member does not discharge air into a user's eyes when the user is reflecting in the mirror and the fan member is at the downward configuration and the mirror is at the tilted configuration.

Therefore, a general object of this invention is to provide a fan base with fan and illuminated mirror configured to cool the neck and torso of a user while applying cosmetics using the mirror.

Another object of this invention is to provide a fan base with fan and illuminated mirror, as aforesaid, in which the mirror and fan are displaced from one another.

Still another object of this invention is to provide a fan base with fan and illuminated mirror, as aforesaid, in which the fan and mirror are directionally adjustable independent of one another.

A further object of this invention is to provide a fan base with fan and illuminated mirror, as aforesaid, in which the mirror and fan may be laterally offset from one another.

A still further object of this invention is to provide a fan base with fan and illuminated mirror, as aforesaid, that is easy to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
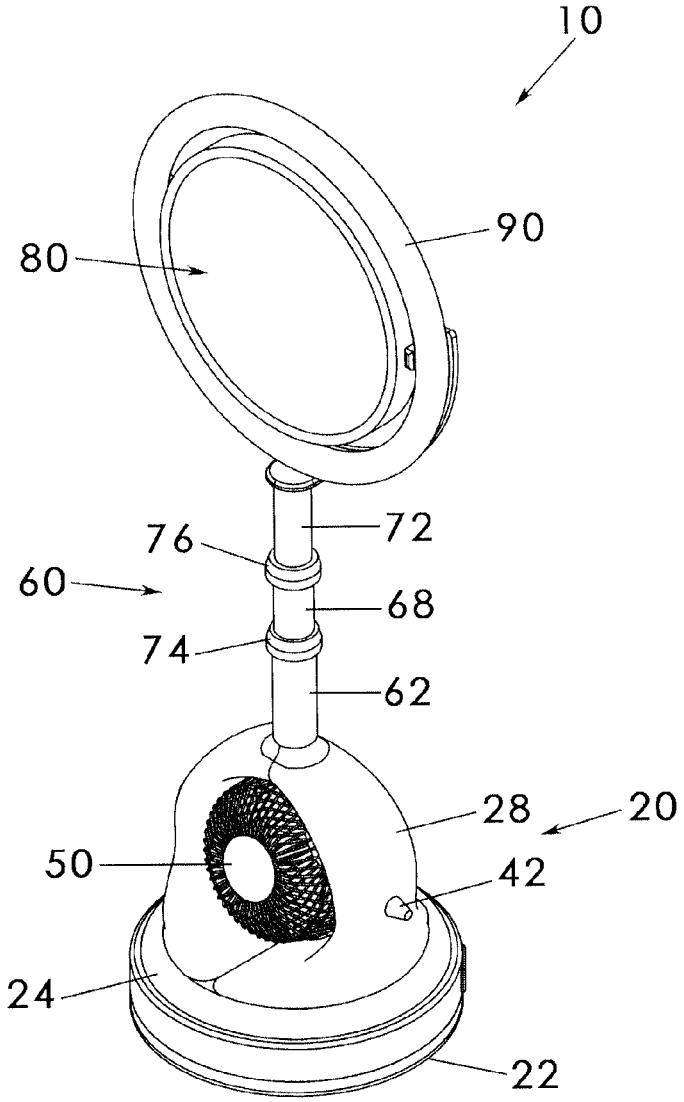
FIG. 1 is a perspective view of a fan base with displaced fan and illuminated mirror according to a preferred embodiment of the present invention.
Figure 2A:
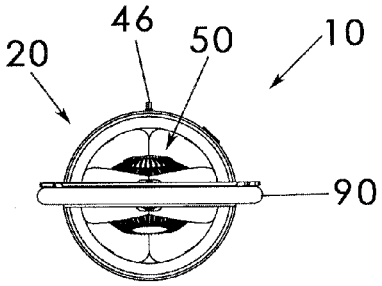
FIG. 2*a* is a top view of the fan base as in FIG. 1.
Figure 2B:
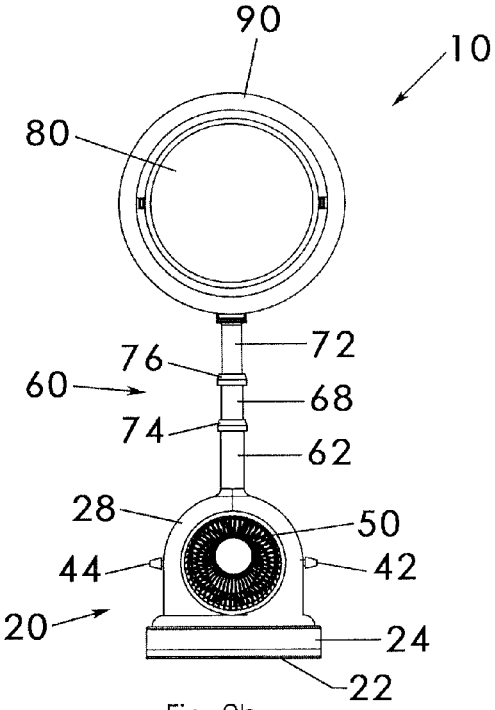
FIG. 2*b* is a front view of the fan base as in FIG. 1.
Figure 2C:
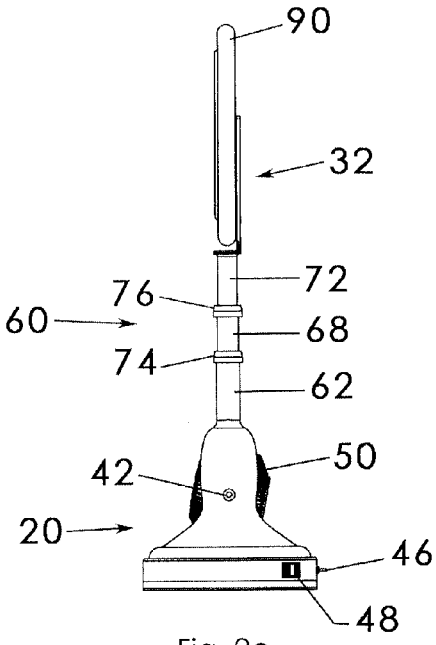
FIG. 2*c* is a side view of the fan base as in FIG. 1.

A fan base apparatus with illuminated mirror and fan according to a preferred embodiment of the present invention will now be described in detail with reference to FIGS. 1 to 5 of the accompanying drawings. The fan base apparatus 10 includes a base member 20, a fan member 50, a length-adjustable rod 60, a mirror 80, and a light 90. The mirror 80 is displaced from the fan member 50 so that air is not discharged into the face of a user looking in the mirror 80, as will be described in more detail below.

The base member 20 may include a flat bottom configured to rest upon a flat surface, such as a dressing table, countertop, or vanity. Although the base member 20 is shown in the drawings as having a circular configuration, it is understood that the base member 20 may have a square configuration, a U-shaped configuration, or another shape that is balanced and capable of supporting the weight of the rest of the apparatus 10 to be described below. The fan member 50 is operatively coupled to the base member 20. The base member 20 is configured such that the fan member 50 may be pivotally coupled thereto. In one embodiment, the base member 20 includes an upper portion 28 that substantially surrounds the fan member 50 and the fan member 50 is pivotally coupled to the upper portion 28 (FIG. 1).

More particularly, the upper portion 28 of the base member 20 may include a pair of opposed fan fasteners (not shown) that define an imaginary horizontal axis extending therebetween. The upper portion 28 may also define holes or recessed areas or apertures complementary to the pair of fan fasteners. The fan member 50 may be pivotally coupled to the pair of fan fasteners so as to selectively rotate about the horizontal axis between upwardly and downwardly directed configurations. It is understood that the pair of fan fasteners may be rods, pins, or the like. The fan member 50 may be pivoted upwardly if a user wishes air to be discharged toward her face or pivoted downwardly if a user wishes air to be discharged toward the torso of her body, e.g. her neck and chest area.

In one embodiment, the base member 20 may include a lower portion 22, an intermediate portion 24, and an upper portion 28 (upper portion described above). More particularly, the lower portion 22 may include the flat bottom disclosed above configured to support the entire apparatus. The intermediate portion 24 may be rotatably or rotationally coupled to the lower portion 22, such as with a thrust bearing 26. Accordingly, the fan member 50 that is coupled to the upper portion 28 of the base member 20 may be rotated such that air discharged from the fan member 50 may be directed away from a user's body while sitting in front of the mirror 80 without the mirror 80 itself being moved, as will further described later.

The length-adjustable rod 60 extends upwardly and connects the base member 20 to the mirror 80 and light 90. More particularly, the length-adjustable rod 60, which may be referred to merely as "the rod", may include a first rod portion 62, a second rod portion 68, and a third rod portion 72 although the rod 60 may include more or less rod portions in various embodiments. The first rod portion 62 may include a lower end 64 attached to the upper end 30 of the base member 20 and an opposed upper end 66, the upper end 66 defining an open configuration and the first rod portion 62 defining an interior area. The second rod portion 68 has a configuration that is complementary to that of the first rod portion 62, the second rod portion 68 being operatively coupled to the first rod portion 62 and movable through the open upper end 66 of the first rod portion 62 between a retracted configuration substantially inside the first rod portion interior area and an extended configuration substantially outside the first rod portion interior area.

Similarly, the third rod portion 72 may have a configuration complementary to the second rod portion interior area. The third rod portion 72 is operatively coupled to the second rod portion 68 and movable between a retracted configuration substantially inside the second rod portion 68 and an extended configuration substantially outside the second rod portion 68. It is understood that the third rod portion 72 is movable through the open end of the second rod portion 68.

The first rod portion 62 may be coupled to the second rod portion 68 with a first friction fastener 74 such as a collet. Similarly, the third rod portion 72 may be coupled to the second rod portion with a second friction fastener 76 such a collet. A respective collet may be manually loosened to enable adjacent rod portions to move slidably between respective retracted and extended configurations and may be manually tightened to stop movement therebetween. It is also observed that loosening respective rod portions enables the mirror 80 and light 90 to be rotated to be directionally offset from the direction of the fan member 50.

Figure 3:
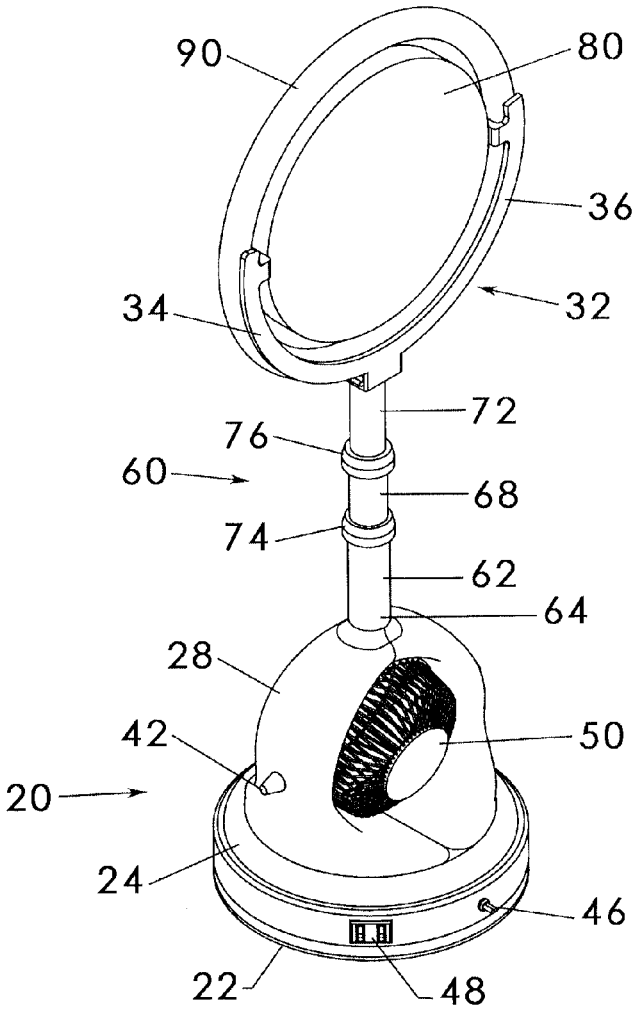
FIG. 3 is a perspective view from another angle of the fan base as in FIG. 1.

A support member 32 is coupled to an upper end of the length-adjustable rod 60 and extends upwardly therefrom. In one embodiment, the support member 32 may include left 34 and right 36 arms configured such that the support member 32 presents a generally U-shaped configuration (FIG. 3). Preferably, the mirror 80 is pivotally coupled to respective ends of the support member 32. Each respective end may include a fastener that is pivotally coupled to a side of the mirror 80. The respective ends of the support member 32 and respective pivot fasteners may be opposed from each other so as to define an imaginary horizontal axis such that the mirror may be selectively pivoted by a user about the horizontal axis between a generally straight configuration and a tilted configuration. More particularly, a "straight" configuration refers to the mirror 80 being in a generally vertical orientation (FIG. 1) and such that a user may see her reflection when situated directly in front of the support member 32 whereas a "tilted" configuration refers to the mirror 80 being tilted rearwardly such that a user may see her reflection when positioned at some level above the support member 32. With this mechanical structure, users of different heights are able to orient the mirror 80 appropriately when seated at a dressing table or even when standing at a sink or vanity. It one embodiment, the mirror 80 may have 180 degrees or even 360 degrees of pivotability.

By contrast, the light 90 may be fixedly attached to the support member 32 so as not to be selectively adjustable. The light 90 may alternatively be coupled to the upper end of the length-adjustable rod 60. It is understood, however, that in some embodiments, the light 90 may be pivotally coupled to the ends of the support member arms 34, 36 so as to be selectively pivotal with the mirror 80. In one embodiment, the light 90 is a fluorescent light bulb although an incandescent or light emitting diode may also work.

With further regard to the base member 20 as first described previously, the upper portion 28 may be operatively coupled to the fan member 50. In an embodiment having an intermediate portion 24 rotationally coupled to the lower portion 22, the orientation and direction of air discharged from the fan member may be selectively moved by a user in relative left and right rotational directions.

Figure 4:
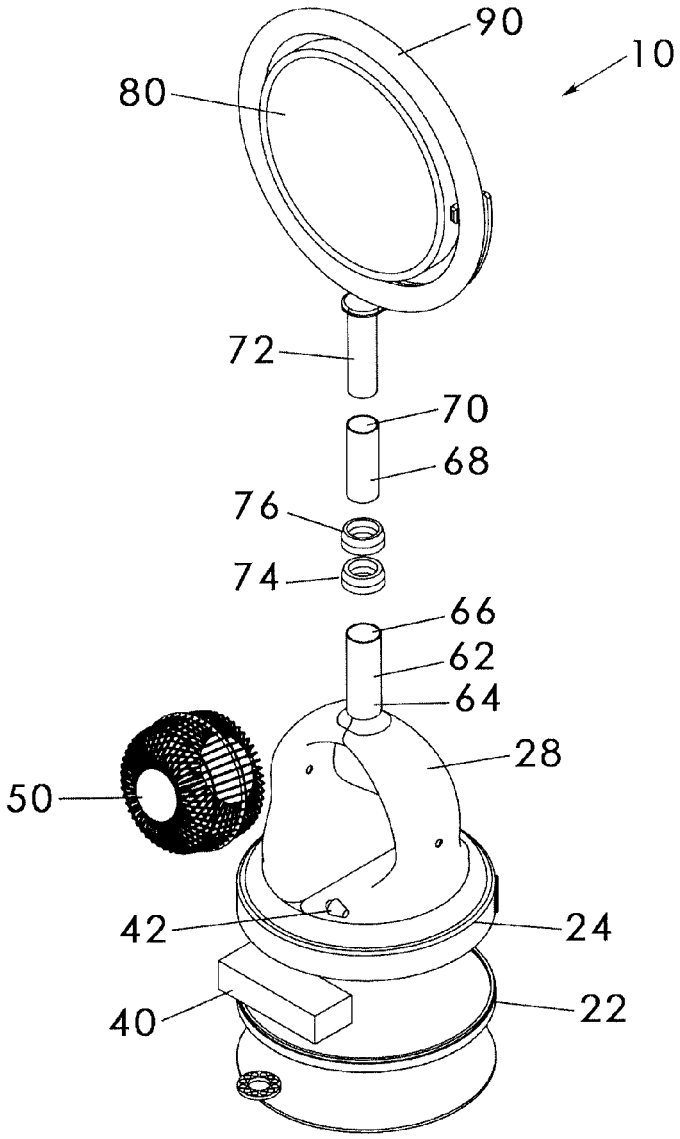
FIG. 4 is an exploded view of the fan base as in FIG. 1.
Figure 5A:
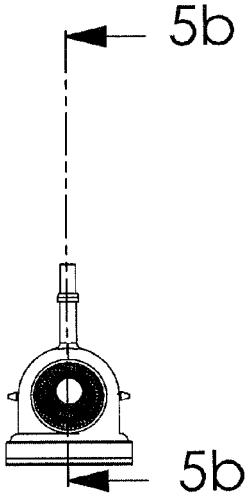
FIG. 5*a* is a front view of a portion of the fan base as in FIG. 1.
Figure 5B:
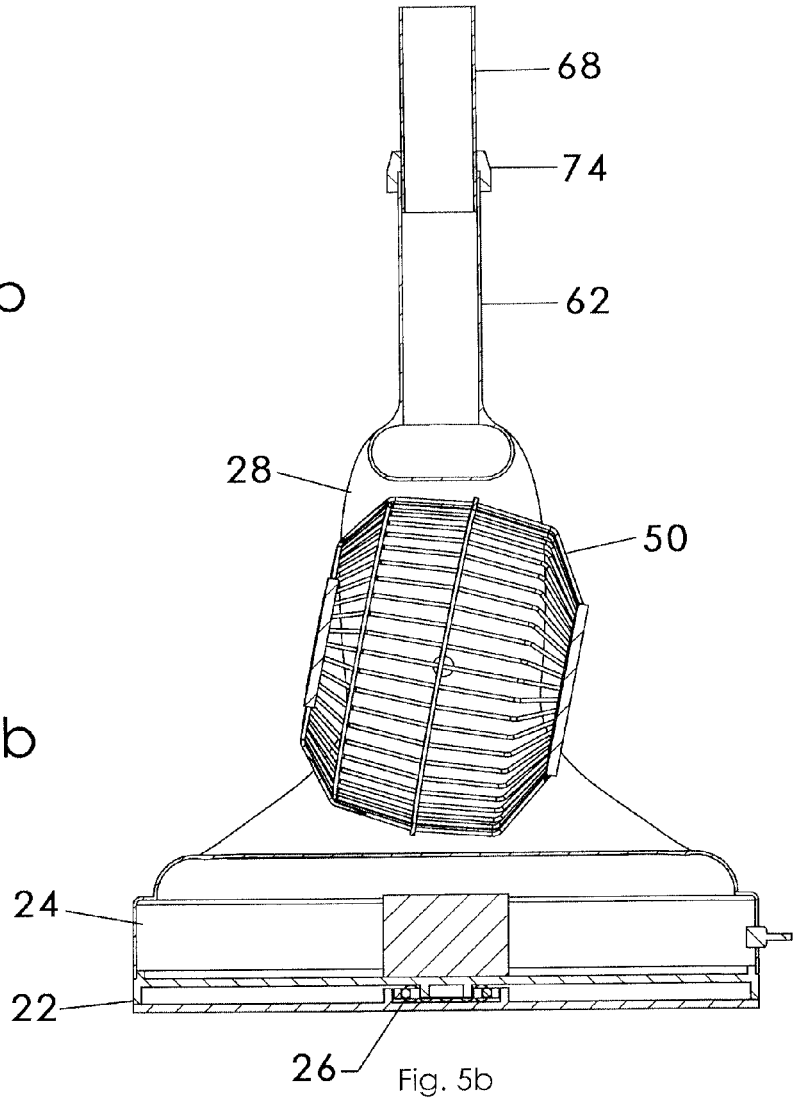
FIG. 5*b* is a sectional view taken along line 5*b*-5*b* of FIG. 5*a*.

In addition, the fan base intermediate portion 24 may define an interior area configured to contain certain electrical components. More particularly, a ballast 40 may be situated in the fan base intermediate portion interior area (FIG. 4). The ballast 40 may be electrically connected to the light 90 and configured to regulate current supplied thereto. In addition, a light actuation input 42, such as a switch or knob may be positioned on the base member 20, such as on the upper portion 28 of the base member 20 as shown in FIG. 1, that is electrically connected to the ballast 40 and configured to selectively adjust a voltage level of electricity to said light 90. In other words, the light actuation input 42 and the ballast 40 may enable a user to selectively dim or brighten the light by almost infinitely adjusting the amount of current allowed to flow from a power source to the light 90 as will be further discussed below.

Similarly, a fan actuation input 44, such as a switch or knob, may be positioned on the base member 20, such as on the upper portion 28 thereof, and configured to regulate passage of current to the fan member 50. It is understood that the fan actuation input 44 may include a simple on/off switch or an almost infinitely adjustable knob to regulate an amount of current allowed to flow to the fan member 50.

Further, a power cord 46 may at one end be electrically connected to the fan member 50, light 90, and respective fan actuation input 44 and light actuation input 42. The power cord 46 may also extend away from the base member 20 and be configured for attachment to an electrical power source, such a wall outlet. It is understood that the electrical components of the fan base and mirror apparatus may be hardwired to a power source, such as may be desirable if the device is wall mounted.

In addition, the base member 20 may also include an auxiliary electrical outlet 48 that is configured to receive an electrical plug from another electrically power device, such as a hair dryer, curling iron, or the like. Devices that may be plugged into the auxiliary electrical outlet 48 may be referred to hereafter as "auxiliary devices."

In use, the fan base and illuminated mirror apparatus 10 may be positioned on a dressing table, vanity countertop, or another flat surface and is supported by the flat bottom of the base member 20. The fan member 50 may be moved between the upward and downward directional configurations, depending if the user desires air discharged by the fan member 50 to be directed toward her face or rather toward her neck and torso, respectively. In an embodiment that includes a base member having an intermediate portion 24 rotationally coupled to a lower portion 22, the user may selectively rotate the direction of the fan laterally, i.e. to the left or to the right. This feature may be beneficial where a user desires air flow in the room but does not want air directed toward her body or face.

The height of the mirror 80 may then be adjusted by first loosening respective friction fasteners 74, 76 and sliding respective rod portions to respective extended configurations as described above. Then, the mirror 80 may be pivotally adjusted between straight or tilted configurations such that the user may see her reflection in the mirror 80 from whatever height her eyes are at relative to the mirror surface. Finally, the fan and mirror actuation inputs 42, 44 may be operated so the fan member 50 and light 90 are energized.

It is understood that while certain forms of this invention have been illustrated and described, it is not limited thereto except insofar as such limitations are included in the following claims and allowable functional equivalents thereof.

The invention claimed is:

1. A fan base and illuminated mirror apparatus for use in cooling a user's neck and torso while the user is positioned adjacent the apparatus, comprising:

a base member having upper and lower portions;

a fan member pivotally coupled to said base member and selectively movable between upward and downward directed configurations, said fan member being connectable to a power source and configured to discharge air when energized;

a length-adjustable rod coupled to said upper portion of said base member and extending upwardly therefrom, said rod being selectively movable between expanded and retracted configurations;

a mirror operatively coupled to an upper end of said rod such that said mirror is vertically displaced from said fan member, and selectively movable between straight and tilted configurations;

a light coupled to said mirror, said light being electrically connectable to a power source and configured to illuminate said mirror when energized; and wherein said fan member discharges air away from a user's eyes when the user is reflecting in said mirror and said fan member is at said downward directed configuration.

2. The fan base and illuminated mirror as in claim 1, further comprising:

a support member coupled to said rod upper end and extending upwardly therefrom, said support member having left and right arm portions defining a generally U-shaped configuration;

wherein:

said mirror is pivotally coupled to said left and right portions of said support member, respectively; and said light is fixedly coupled to said support member such that said mirror is selectively movable relative to said light.

3. The fan base and illuminated mirror as in claim 1, wherein said rod includes:

a first rod portion having a lower end fixedly attached to said upper end of said base portion and an upper end having an open configuration, said first rod portion defining an interior area; and a second rod portion having a configuration complementary to said first rod portion interior area, said second rod portion being operatively coupled to said first rod portion and movable between a retracted configuration substantially inside said first rod portion interior area and an extended configuration substantially outside said first rod portion interior area.

4. The fan base and illuminated mirror as in claim 3, wherein said first rod portion is coupled to said second rod portion with a first friction fastener configured to selectively hold said second rod portion at a relative position relative to said first rod portion.

5. The fan base and illuminated mirror as in claim 4, wherein:

said second rod includes an upper end having an open end and defining an open interior area;

said fan base and illuminated mirror further comprising a third rod portion having a configuration complementary to said second rod portion interior area, said third rod portion being operatively coupled to said second rod portion and movable between a retracted configuration substantially inside said second rod portion interior area and an extended configuration substantially outside said second rod portion interior area.

6. The fan base and illuminated mirror as in claim 5, wherein said second rod portion is coupled to said third rod portion with a second friction fastener configured to selectively hold said third rod portion at a relative position relative to said second rod portion.

7. The fan base and illuminated mirror as in claim 6, wherein said first friction fastener and said second friction fasteners are collects.

8. The fan base and illuminated mirror as in claim 2, wherein each said left and right arm portions of said support member include opposed pivot fasteners that define a horizontal axis therebetween, said mirror being pivotally coupled to said pivot fasteners so as to selectively pivot about said horizontal axis between said straight and said tilted configurations.

9. The fan base and illuminated mirror as in claim 1, wherein said base member lower portion includes:

a bottom portion configured to bear against a support surface;

an intermediate portion rotatably coupled to said bottom portion, said intermediate portion being coupled to said fan, such that the lateral direction of said fan is selectively adjustable.

10. The fan base and illuminated mirror as in claim 9, wherein said base member intermediate portion defines an interior area;

said fan base and illuminated mirror further comprising:

a ballast situated in said interior area of said base member intermediate portion and electrically connected to said light; and a light actuation input electrically connected to said ballast and configured to selectively adjust a voltage level of electricity to said light.

11. The fan base and illuminated mirror as in claim 10, wherein said base member upper portion is coupled to said intermediate portion and configured to surround said fan member.

12. The fan base and illuminated mirror as in claim 1, wherein said light is a fluorescent light.

13. The fan base and illuminated mirror as in claim 1, further comprising:

a power cord electrically connected to said fan member and said light, said power cord extending from said base and configured to connect to an electrical power source; and an auxiliary electrical outlet situated on said base that is electrically connected to said power cord such that auxiliary electrical product are selectively energized when plugged in to said auxiliary electrical outlet.

14. The fan base and illuminated mirror as in claim 1, further comprising a fan actuator input situated on said base and electrically connected to said fan member and configured to selectively enable electricity from the power source to energize said fan member.

* * * * *